United States Patent [19]

Rigatti-Luchini

Best Available Copy

[11] 4,247,735

[45] Jan. 27, 1981

[54] ELECTRIC HEATING CRUCIBLE

[76] Inventor: Luchino Rigatti-Luchini, Via Bellini, 17-Rovello Porro, Colo.MO, Italy

[21] Appl. No.: 9,327

[22] Filed: Feb. 5, 1979

[30] Foreign Application Priority Data

Feb. 16, 1978 [IT] Italy ..... 20325 A/78

[51] Int. Cl.[3] ..... H05B 3/66

[52] U.S. Cl. ..... 13/25; 13/31 R; 164/258; 164/297; 219/420; 219/427; 219/521; 219/552; 432/263

[58] Field of Search ..... 13/20, 22, 25, 31; 219/275, 385, 427, 420, 421, 521, 541, 552, 553; 432/262, 263; 164/258; 156/246; 118/7, 22; 116/233; 427/47, 250

[56] References Cited

U.S. PATENT DOCUMENTS

| | | | |
|---|---|---|---|
| 558,357 | 4/1896 | Coneey | 219/427 |
| 2,013,755 | 9/1935 | Hediger | 13/22 |
| 2,557,530 | 6/1951 | Bancroft | 13/25 |
| 2,615,060 | 10/1952 | Marinace et al. | 13/25 |
| 2,693,521 | 11/1954 | Alexander | 13/25 |
| 2,851,579 | 9/1958 | Pfeiffer | 219/427 |
| 2,996,418 | 8/1961 | Bleil | 13/25 X |
| 3,199,158 | 8/1965 | Rigatti-Luchini | 164/258 |
| 3,387,116 | 6/1968 | Dupuis | 13/25 X |
| 3,529,068 | 9/1970 | Edwards et al. | 13/25 |
| 3,647,384 | 3/1972 | Dessureult | 423/345 |

FOREIGN PATENT DOCUMENTS

| | | | |
|---|---|---|---|
| 238762 | 10/1911 | Fed. Rep. of Germany | 13/25 |
| 416607 | 12/1946 | Italy | 13/25 |

*Primary Examiner*—Volodymyr Y. Mayewsky

*Attorney, Agent, or Firm*—Guido Modiano; Albert Josif

[57] ABSTRACT

A Joule effect electric furnace for goldsmith, dental and the like melting processes comprises a graphite crucible which constitutes by itself an electric resistance element suitable for the Joule effect heating and is connected to an electric power supply.

1 Claim, 3 Drawing Figures

ELECTRIC HEATING CRUCIBLE

BACKGROUND OF THE INVENTION

This invention relates to a Joule effect electric furnace for goldsmith, dental, and the like melting processes.

The Joule effect electric furnaces currently in use employ, as a heating element, a resistor which may be formed from one of several alloys, such as nichrome or more complex alloys like "Kanthal", or even from wire platinum. The use of such alloys affords operating temperatures in the order of 1200° C., whereas platinum raises these temperature capabilities to 1500° C.

To achieve still higher temperatures, graphite resistors have been sometimes used which afford working temperatures in the 1800° C. to 2000° C. range, provided that they are operated under vacuum conditions, since at temperature levels exceeding 1200° C., when operated in an air environment, graphite would wear out quite rapidly by releasing carbon dioxide.

In the above-described furnaces, the heating of the crucible containing the metal or alloy to be melted is carried out directly, i.e. the heat is transferred from the resistor to the crucible until the desired melting temperature is achieved. This construction makes the use of a heating chamber unavoidable, inside which chamber the resistor and crucible are positioned, the chamber requiring a lining of refractory material capable of withstanding the high operating temperatures involved. However, it is not infrequent for the chamber, when subjected to high temperatures, to become shorted owing to the reduction of the necessary refractories from oxide to metals, even where such refractories contain 80% alumina, which is the maximum amount allowable for preparing the refractory slurry.

A failure of the refractory requires considerably prolonged and expensive adaptational steps, which are of course to be carried out by skilled personnel, while the furnace operation must be discontinued for as long as one day, which is generally the time required for the refractory to dry completely.

SUMMARY OF THE INVENTION

Thus, it may be seen that a failure of the refractory constitutes a most critical aspect of the prior art Joule effect electric furnaces, and this invention sets out to provide a Joule effect electric furnace, wherein the refractory for the heating chamber becomes unnecessary, even when very high temperatures of up to about 1900°-2000° C. have to be attained, thus eliminating one of the principal causes of failure and damage.

Another object of the invention is to provide an electric furnace as above, which has a simplified construction and such as to enable the user to service the furnace unaided, since no availability of skilled personnel is required and the servicing operations are very quickly carried out.

A further object of this invention is to provide an electric furnace which can be easily formed from readily available materials, is of extremely simple construction, as well as safe and reliable to operate, and competitive from a purely economical standpoint.

These and other objects, such as will be apparent hereinafter, are achieved by a Joule effect electric furnace with a chamber communicating with a vacuum source, a crucible arranged in said chamber, a mould, electric current conductor means extending into said chamber and connected to a supply of electric energy, characterized in that said crucible is made of graphite and has one end thereof connected to one said conductor means and another end thereof connected to another said conductor means, said one and said another conductor means having opposite polarity, thereby to cause electric current to flow from said one end of the crucible towards said other end thereof and heat the crucible by Joule effect developed by the inherent resistance of the crucible material.

BRIEF DESCRIPTION OF THE DRAWING

Further features and advantages will become more clearly understood from the following description of a preferred, though not restrictive, embodiment of a Joule effect electric furnace for goldsmith, dental, and the like melting processes, illustrated by way of example only in the accompanying drawing, where.

DESCRIPTION OF A PREFERRED EMBODIMENT

Figure 1:
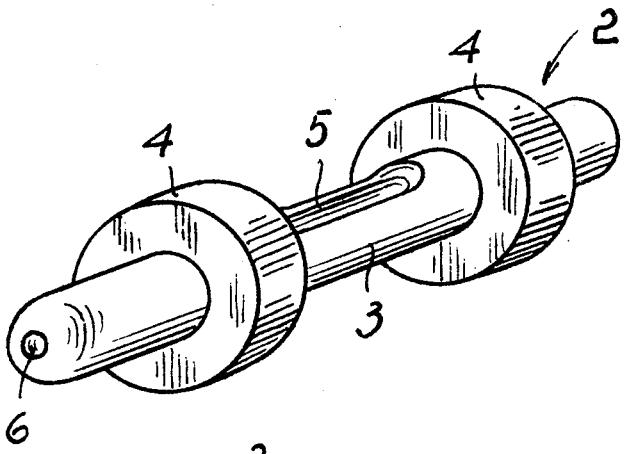
FIG. 1 is a schematical perspective view of the graphite crucible.
Figure 2:
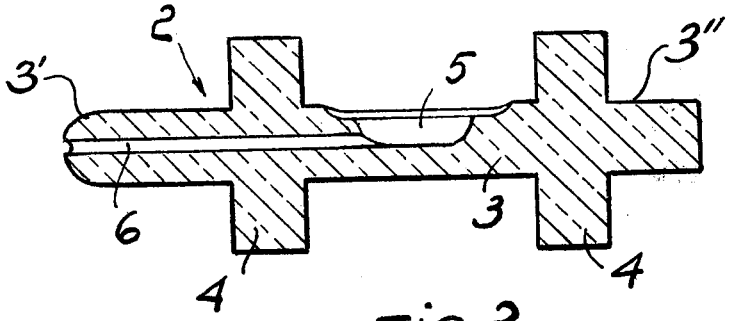
FIG. 2 is a longitudinal section of the crucible.
Figure 3:
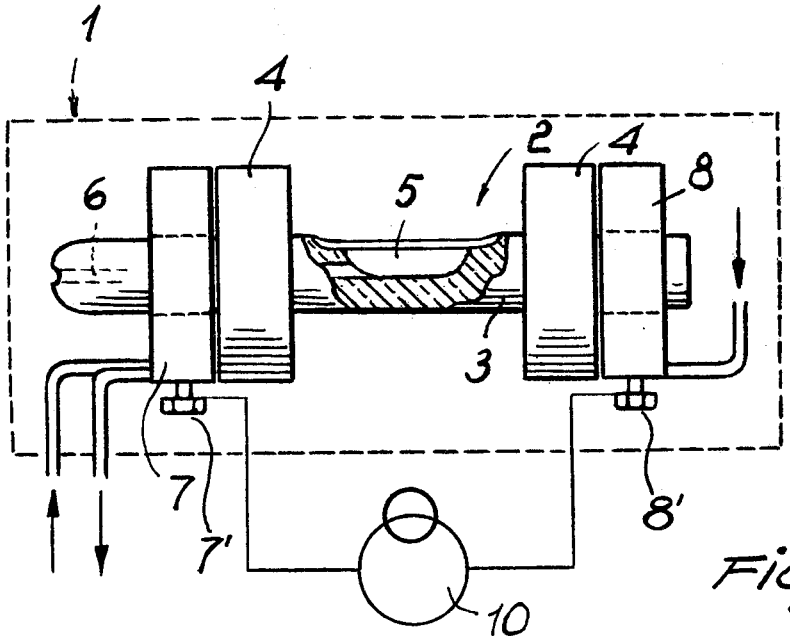
FIG. 3 schematically shows the electric furnace according to the invention, as incorporating the crucible of the preceding figures.

With reference to the drawing figures, the Joule effect electric furnace according to this invention is of centrifugal type and comprises a vacuum chamber, schematically indicated at 1 and no further described since it may be of any design known per se. For instance the chamber may be of the type disclosed in my U.S. Pat. No. 3,199,158 except for the resistance wire which is not necessary any more. My above U.S. patent is here incorporated by reference. The chamber 1 is in communication with a vacuum source, such as to generate within the chamber a desired vacuum level. Arranged inside said chamber 1 is a crucible which comprises a lathe turned elongated substantially cylindrical body 2, having a cylindrical intermediate portion 3, preferably positioned within the chamber 1 with its axis horizontally laid, and a pair of spaced apart enlarged cylindrical collets or collars 4.

In the cylindrical portion 3, at the area included between the two collets 4, a boat- or trough-like crucible cavity 5 is formed which is the crucible proper, its bottom communicating with an axial bore 6 extending axially through the cylindrical portion 3 and emerging at one mold facing end 3' thereof.

The basic feature of the body 2 constituting the crucible is that it is made of graphite and acts at one time as an electric resistor and crucible proper for confining the metals to be melted. Thus, a direct heating of the alloy or metal to be melted is accomplished. This type of resistor/crucible, by operating under the vacuum created within the chamber 1, will wear out very slowly, such as to comfortably accept up to a hundred melting cycles before the resistor/crucible comprising the body 2 requires replacement.

This solution eliminates the need of changing the refractory to rebuild the heating chamber, since no use of refractory material is contemplated therein and the metal being melted is heated directly.

To the cylindrical portion 3, externally to spigot end formation 3', 3'' of the area bound by the collets 4, there are attached first and second copper side pieces, respectively 7 and 8, which constitute current conducting electrodes connected through electric connector means 7', 8' to a transformer 10 equipped with a voltage variator. The transformer is preferably a low voltage, high amperage one, such as to provide the desired Joule effect.

In the arrangement just described, it can be observed that the body 2 exhibits a reduced sectional area at the hollow region where the boat-like crucible 5 is formed. The body 2, as an electric current is caused to flow therethrough, will become red hot precisely at that region owing to the higher resistance to the current flow of the latter by reason of its smaller volume, whereas the cylindrical collets 4, which are located outside of the region occupied by the boat-like crucible 5, serve for creating regions of lower electric resistace thanks to their larger sectional areas, thereby they are not liable to become red hot.

The cited copper side pieces 7 and 8 which are preferably of annular shape and in side contact with the collects 4 are cooled by an internal cooling circuit, of which only the inflow and outflow pipes are diagrammatically shown, as is customary for furnaces of this type, which is of conventional design and no further described herein. Also in this case the cooling system may be of the kind disclosed in my above indicated U.S. patent.

It will be apparent how, with the arrangement described, the crucible, whenever replacement thereof becomes necessary, can be easily removed by moving the side pieces 7 and 8 apart and inserting a new crucible.

By supplying the unit through a voltage variator, as mentioned, one is enabled to adjust at will the tension applied to the electrodes 7 and 8, and accordingly the operating temperature, generally in the range from 600° C. to 1900° C.

As mentioned hereinabove, the body 2 constituting the resistor/crucible is placed in a chamber under a certain vacuum level for the purpose of preventing premature wear of the graphite which makes up the crucible, above 1200° C., owing to the release of carbon dioxide.

The metal that gradually melts within the boatlike crucible 5 flows through the bore 6, and hence to the mould not shown where it solidifies, either under the influence of centrifugal or gravity forces, as is usual with furnaces of this type. If the flow towards the mould is by gravity, the crucible is arranged vertical.

It should be noted, however, that cooling water is circulated through the chamber even during optional centrifugation, as already disclosed in my above U.S. Pat. No. 3,199,158 such as to initially cool the mould from the side of the mould which is opposedly located with respect to the riser, such as to achieve solidification under controlled heat dissipation condition, which results in a solid and homogeneous casting It will be apparent from the foregoing that the invention achieves its objects, and in particular the fact is stressed that by providing a crucible directly formed from an electrically conductive material, thereby the crucible becomes itself the system heating resistor, a drastic simplification of the furnace construction is accomplished, which the refractory materials are eliminated which constitute, as mentioned, a potential source of serious problems.

Furthermore, the arrangement described affords adjusting capabilities of the crucible capacity, inasmuch as the crucible can be replaced with other crucibles of different sizes, the one requirement being here the use of a transformer equipped with a voltage variator dimensioned to suit the amount of metal or alloy to be melted.

It should be further added, for completeness sake, that the melting process being carried out inside the boat-like crucible 5 can be monitored through a inspection window, and that tinted glass panes, as calibrated against an optical pyrometer, may be provided to determine the various desired temperatures. This approach being specially useful because, above 1200° C., it is no longer possible to employ thermocouples. Obviously, and as mentioned above, a desired temperature variation is obtained through operation of the voltage variator.

Thus, an extremely simple furnace has been provided, and above all, any risk of failure eliminated by virtue of the crucible and heating resistor being formed as a single member or unit, which member or unit can be easily and quickly replaced, as mentioned, even by the furnace operator himself.

The invention as described is susceptible to many modifications and variations, which are all intended to fall within the scope of the instant inventive concept.

Moreover, any of the details may be replaced by other technically equivalent elements.

In practicing the invention, the dimensions as well as the shapes may be varied within broad limits to suit individual application requirements.

I claim:

1. A Joule effect heated crucible for centrifugal electric furnaces of the vacuum chamber type, wherein the crucible is constituted of a substantially cylindrical elongated body of graphite having integral therewith spaced apart collar formations and between said collar formations an intermediate portion, said intermediate portion having a diameter substantially smaller than the diameter of said collar formations, a trough forming cavity in said intermediate portion for metal to be melted therein, said trough forming cavity having a bottom, spigot end formations extending from said collar formations opposite to said intermediate portion and coaxial and integral therewith, said spigot end formation having a diameter substantially smaller than the diameter of said collar formations, one of said spigot end formations having a mold facing extremity, an axial duct opening at one end thereof into said trough forming cavity at said bottom thereof and emerging to the outside with the other end thereof at said mold facing extremity of one of said spigot end formations thereby said duct extending from said trough forming cavity axially through part of said intermediate portion in the zone between said trough forming cavity and one of said collar formations nearest to said mold facing extremity and through said one collar formation and the adjacent mold facing extremity spigot end formation to provide communication between said trough forming cavity and the outside at said mold facing extremity, annular copper side pieces slipped over each said spigot end formation adjacent said collar formations, electric connector means on each said annular copper side pieces connectable to a source of electric current of opposite polarity thereby to allow flow of current from one of said copper side pieces towards said collar formations and therefrom towards said intermediate portion, said trough forming cavity therein, the other of said collar formations and the other of said copper side pieces and to provide thereby a Joule effect heating in said crucible of greater intensity at said intermediate portion thereof of smaller diameter, and cooling circuit conduits connected with said copper side pieces.

* * * * *